US006349909B1

(12) United States Patent
Zarrow et al.

(10) Patent No.: US 6,349,909 B1
(45) Date of Patent: Feb. 26, 2002

(54) HANGER ASSEMBLY

(75) Inventors: Nancy Zarrow, Wellesley; Kenneth Buckley, Needham, both of MA (US)

(73) Assignee: Wrap Solutions, Inc., Needham, MA (US)

( * ) Notice: Subject to any disclaimer, the term of this patent is extended or adjusted under 35 U.S.C. 154(b) by 0 days.

(21) Appl. No.: 09/387,686

(22) Filed: Aug. 31, 1999

Related U.S. Application Data

(60) Provisional application No. 60/098,947, filed on Sep. 3, 1998.

(51) Int. Cl.[7] ..... A47B 96/06

(52) U.S. Cl. ..... 248/220.41; 40/642.01; 211/57.1; 248/220.22

(58) Field of Search ..... 248/220.41, 220.21, 248/225.21, 225.11, 223.21; 211/59.1, 57.1, 58, 87.01, 106.1; 40/642.01, 642.02

(56) References Cited

U.S. PATENT DOCUMENTS 3,198,469 A * 8/1965 Callanan ..... 248/220.22
3,289,994 A * 12/1966 Burmeister ..... 248/220.41
4,026,508 A * 5/1977 Ziegler ..... 248/220.31
4,783,033 A * 11/1988 Valiulis ..... 248/220.41
5,259,220 A * 11/1993 Fredrickson ..... 211/59 X
5,423,436 A * 6/1995 Morrow ..... 211/59.1
5,441,161 A * 8/1995 Meri ..... 211/57.1
5,815,970 A * 10/1998 Thalenfeld et al. ..... 40/642.01
5,957,422 A * 9/1999 Shea ..... 248/230.1

* cited by examiner

*Primary Examiner*—Ramon O Ramirez
*Assistant Examiner*—Tan Le
(74) *Attorney, Agent, or Firm*—Mirick, O'Connell, DeMallie & Lougee, LLP

(57) ABSTRACT

This invention features a hanger assembly for displaying product in a retail store environment, comprising an integral elongated hook member for carrying the product to be displayed, the hook member comprising a proximal end section, a distal end section, and an intermediate portion, wherein the intermediate portion comprises a first, inner, generally straight section adjacent to the proximal end section, and a first arcuate product hanging section adjacent to the inner section and adjacent to the distal end section; and a base member including means for removably fixing the base member to a display panel, the base member defining at least one receiving opening for receiving the proximal end section of the hook member, wherein the hook member can pivot horizontally about the end section, to allow the product being displayed to be moved horizontally.

15 Claims, 7 Drawing Sheets

HANGER ASSEMBLY

CROSS-REFERENCE

This is a continuation-in-part of U.S. application Ser. No. 60/098,947, filed on Sep. 3, 1998.

FIELD OF THE INVENTION

This invention relates to a hanger assembly for supporting articles on apertured panel commonly known as "Pegboard", or a newer form of display wall known as "Slat Wall", both hereinafter referred to as the "panel". Such an assembly includes a base member, which is easily removable from the pegboard/slat wall, and a protruding hook on which the articles hang.

BACKGROUND OF THE INVENTION

A hanger assembly is disclosed in Burmeister U.S. Pat. No. 3,289,994 in which the hanger is adapted to be releasably attached to the panel by a separate mounting bracket, hereinafter known as the "base member". The base member has a pair of horizontally spaced fingers which either extend through the holes in a pegboard panel, or up behind the slat of a slat wall. The hanger and its receiving openings in the base member are square, so that the hanger cannot pivot or swing horizontally about the base member.

SUMMARY OF THE INVENTION

The invention relates to a hanger assembly in which the hook (hanger) can pivot or swing horizontally relative to the base member, allowing the articles to be displayed perpendicularly to the panel, while still being viewed fully. This allows more articles to be displayed per display panel area. This invention is an improvement on current hanger assemblies for use in certain applications. It has been determined that the popular handled gift bag require an improved display system so as to reduce the amount of retail space needed per volume of product. Several attempts have been made, all very costly, to reduce the wall space per design. The approach of this invention decreases the amount of wall space by a very large amount (a range of decrease depending on the system upon which it is improving), greatly reduces the cost of current display systems trying to deal with this and in some instances reduces production costs (i.e. extra parts on the product to help with displaying products closer together). In addition, several products of certain sizes and uses can be displayed or stocked in retail establishments more compactly while simultaneously increasing accessibility. This refers primarily to products which are wider and taller than they are thick, such as gift bags, and sheets of wrapping paper or sandpaper, yet need to be displayed in a way that facilitates full viewing and easy selection on the part of the consumer. The hook on which the articles hang fits into the base member in such a way as to allow a horizontal pivoting motion, and is shaped to facilitate the hanging of articles perpendicular to the panel and current display angles.

The hook is of a new design which is calculated to support merchandise perpendicular to the panel, yet pivot horizontally to facilitate viewing the front of the perpendicular to the panel, yet pivot horizontally to facilitate viewing the front of the product in full view separate from additional product to the left or right of this hanger assembly. This hanger assembly allows multiple instances of product to be hung on one hanger assembly. This is designed to be placed on a panel in conjunction with several additional hanger assemblies of the same type to the left and to the right, such that all hanger assemblies operate in the same fashion. This will result in the increase of product stocked/displayed in relation to area of wall space used.

An added benefit is the increased safety which other hanger assembly designs have tried to obtain, such as responding to interference in a manner that protects the passerby from the type of injury that would be caused by a non-movable hanger assembly.

BRIEF DESCRIPTION OF THE DRAWINGS

Other objects, features and advantages will occur to those skilled in the art from the following description of the preferred embodiment, and the accompanying drawings, in which.

DETAILED DESCRIPTION OF THE PREFERRED EMBODIMENTS

Figure 1:
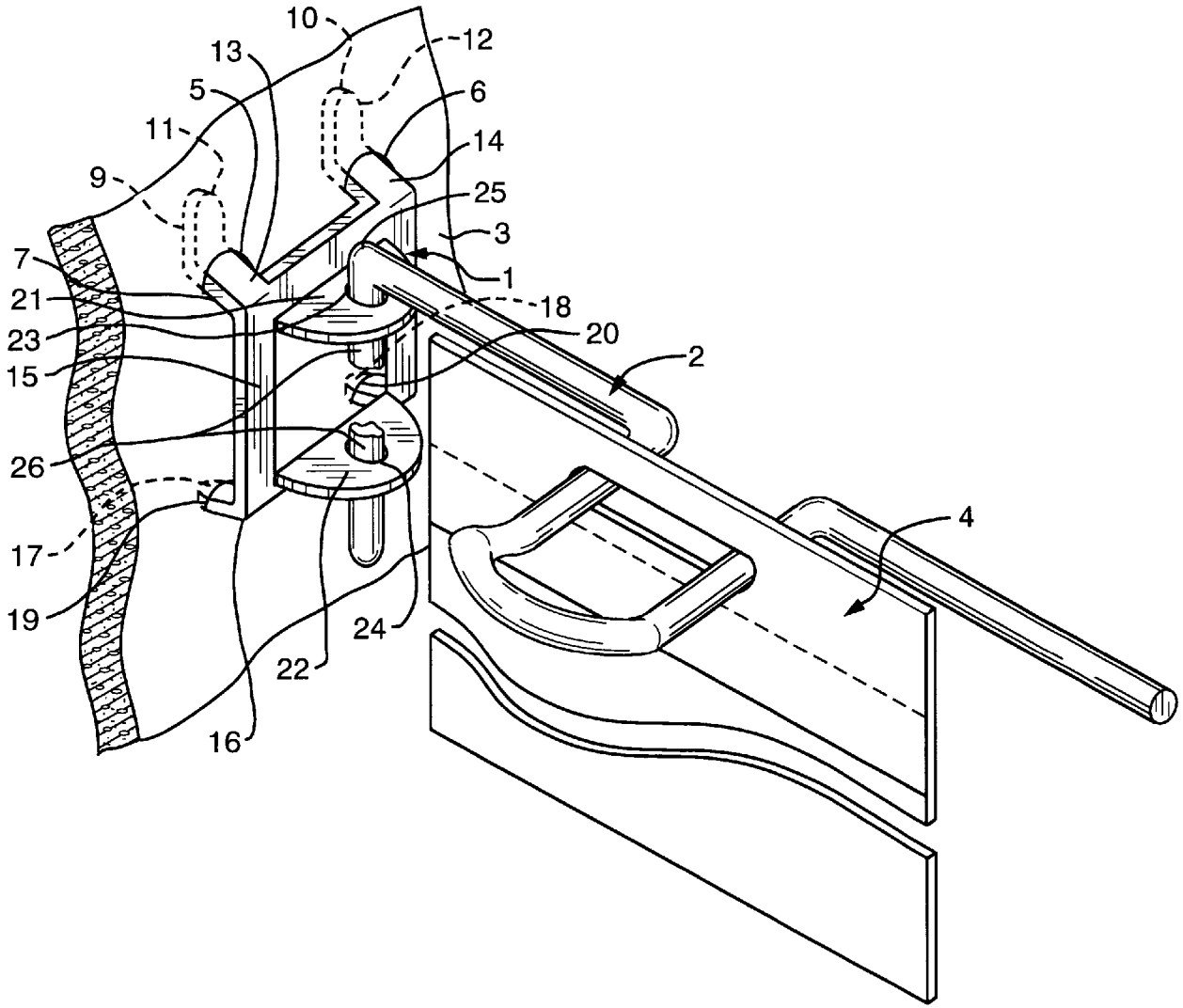
FIG. 1 is a perspective view of a perforated panel (pegboard) with one embodiment of the improved display hook assembly of this invention in use displaying a product by using the unique features.
Figure 6:
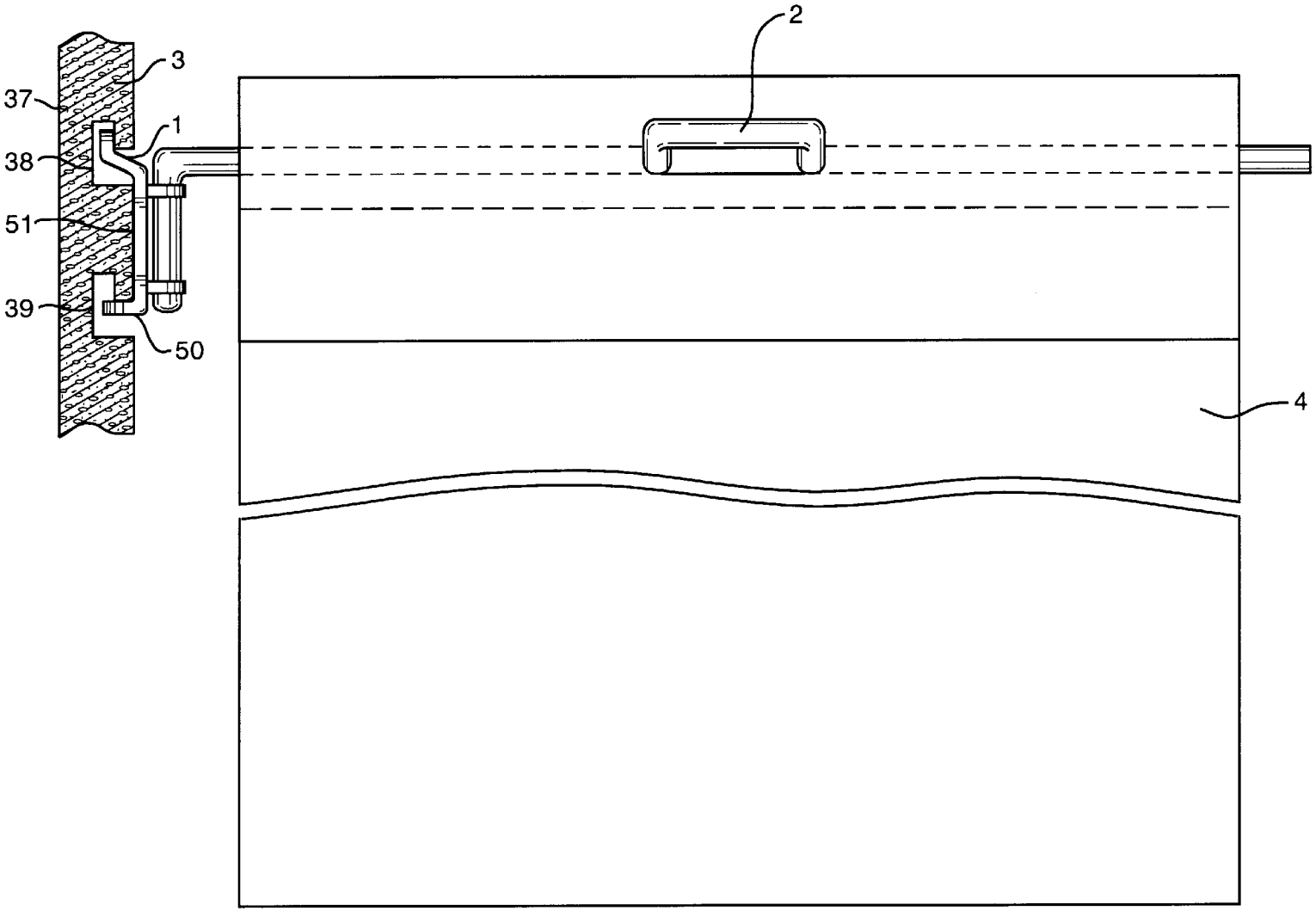
FIG. 6 is a side view of the embodiment in use with a product hanging off of it, being hung on a slat wall, with a cut-away of the slat wall.

Referring now to FIG. 1, numerals 1 & 2 refer to the basic two parts of the preferred embodiment of invention hanger assembly, 1 being the base member, hereinafter referred to as base, and 2 being the hook member hereinafter referred to as hook. FIG. 1 shows the entire assembly in use on a pegboard panel. Numeral 3 refers to the panel, being pegboard in FIG. 1. (Slat wall is represented in FIG. 6, but will respond with all the same properties for purposes of this FIG. 1 as well.) Numeral 4 is the product that is being displayed/stocked on element 2.

Panel 3 has holes 5,6 which are spaced at industry standard distance, of industry standard diameter and of industry standard depth. FIG. 1 shows a cut section of panel 3, which represents one set of four holes necessary for each base 1 per hanger assembly. In actual application, holes 5,6 continue horizantally and vertically across the entire panel 3 , whatever the total size is. Base 1 adheres to panel 3 by the insertion of two L-shaped fingers (9,10) that are stamped (FIG. 3) during the stamping operation and bent backward and then upward. Base 1 is inserted into panel 3 with or without hook 2 attached. The fingers 9,10 are a commonly known approach for holding a base member onto a pegboard or slat wall, with the ends 11,12 being inserted horizontally into holes 5,6 while base 1 is held horizontally. Then the base is lowered toward panel 3, such that ends 11,12 continue an upward motion moving toward the back of panel 3, with lower portion 13,14 of the L-shaped fingers 9,10 coming to rest on the bottom 7,8 of holes 5,6.

The base plate 15 of the base 1 member rests against panel 3. There may also be two bottom feet 17,18, which are stamped (FIG. 3) out as part of the original stamping and then bent (16) backward 90 degrees. These feet 17,18 enter holes 19,20 for situations in which added stability is desired.

When product 4 is hung on hook 2, the weight of product 4 encourages hook 2 to rotate counter clockwise, pushing to the bottom 13 of finger 9 down against the bottom 7 of hole 5, and pushing the bottom 14 of finger 10 up against the top of hole 6. The feet 15,18 provide two additional pressure points for stability, in cases where hole 5 and/or 6 are worn or larger than planned. Feet 17 and 18 will also be pushed down and up respectively, when product 4 is placed on hook 2. Also, feet 17,18 are measured to be a certain distance down from fingers 9,10 to create a tight fit causing fingers 9,10 to be pulled down snug against the bottom holes 5,6 leaving an insignificant amount of play in the fit, preventing any significant twisting motion when product 4 is hung.

Figure 3:
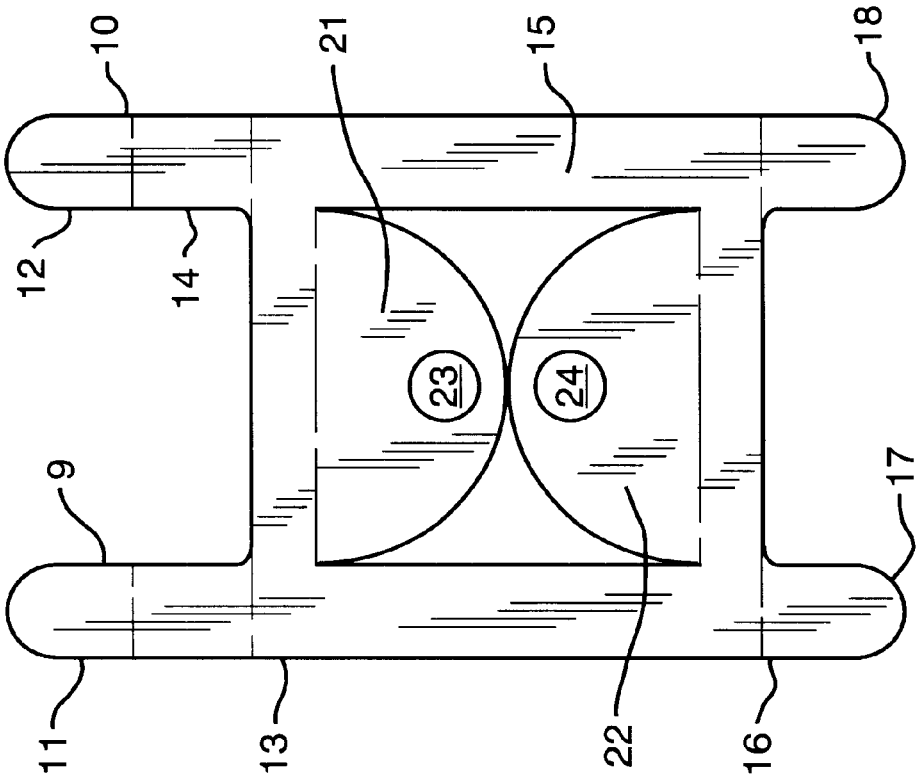
FIG. 3 is a front view of the base member after being stamped or punched out of metal, with all parts cut away, but prior to any bending operations.
Figure 5:
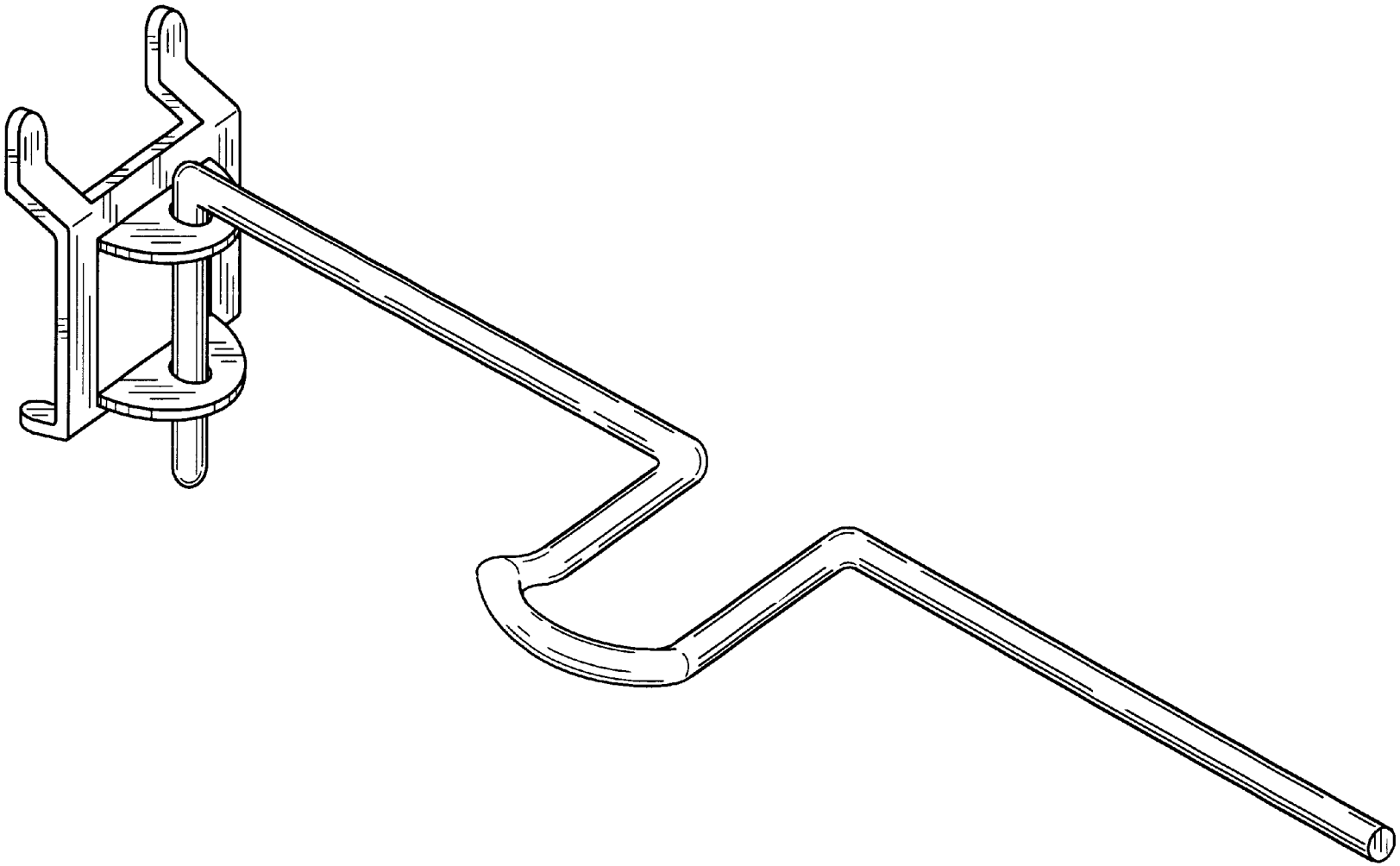
FIG. 5 is a complete perspective view of the base member and hook fully assembled without being applied to a panel and without being used in an application.

When the base plate 15 part of the base is stamped (FIG. 3) two opposing semi-circular pieces of metal 21,22 are left tangentially facing each other in the center. Inside the arc of each semi-circle is a stamped out hole (FIG. 3, 23,24). The two semi-circular metal pieces 21,22 are bent forward until they are about horizontally parallel or nearly parallel to one another, as shown in FIG. 5. Items 21,22 are made in a semi-circle shape to helo prevent contact with product 4 during pivoting hook 2. It is into these two holes 23,24 that the hook 2 is easily placed, with or without product already hanging on it. Gravity and the weight of product 4 keeps hook 2 in holes 23,24. Additionally, the weight of product 4 keeps feet 17,18 firmly pressing into holes 19,20. This design allows for the natural application of forces to maintain the assembly's position and stability. The hook will press down on semi-circle 21 but not with undue force because more pressure is placed against the back of the bottom hole 24, which can only increase the application of base 1 to panel 3. The fingers 9,10 are long enough and broad enough to distribute the weight of pressure against the back of panel 3, preventing breakage of panel 3. Typical panel 3 is made of material sturdy enough to support the certain type product 4 for which this assembly is designed.

Preferably, upper semi-circle 21 is at an angle slightly downward from the horizontal. In some cases of product 4, this will allow for the natural gravitational pull of hook 2 to come to a resting place directly perpendicular to panel 3, as opposed to remaining in whatever position it was put in last, when pivoted to the left or to the right.

Figure 2:
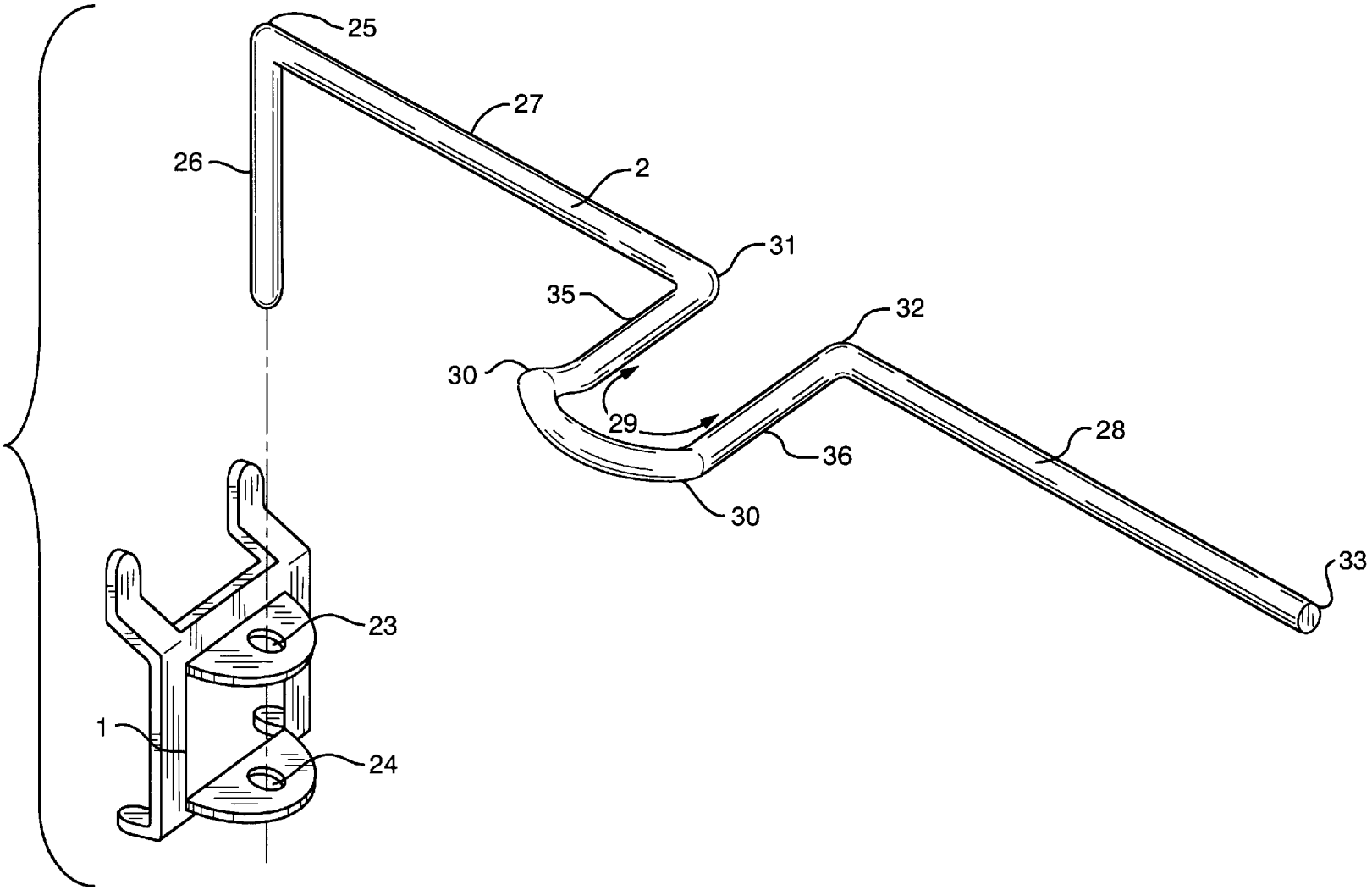
FIG. 2 is a perspective view of the base member of FIG. 1, and a perspective view of the hook member of FIG. 1.

Referring to FIG. 2, hook 2 is preferably made of one continous length of round wire with a diameter barely smaller than the inside diameter holes 23,24. It emerges out from the back panel 3 to a normal length and size of display hooks, but with the unique configuration of supporting the hanging of product perpendicular to previously known designs. There is a 90 degree downward bend 25 from which the wire continous to extend downward to accomplish the priximal end section 26, providing the section of wire that facilitates hook 2 being inserted into holes 23,24 of base 1 (FIG. 2). There are two lengths of generally co-linear wire 27,28 which continue along the length necessary to make room for product 4 (FIG. 1). Section 28 is the distal end section, and section 27 is the inner section of the intermediate portion, which extends between points 25 and 32.

In about the center of the length from bend 24 to end 33, there is a generally U-shaped bend 29 created by bending the wire first horizontally 90 degrees at the end of length 27, creating bend 31, rforming the arcuate "U" 29, and then another horizontal 90 degree bend 32, before continuing to create length 28. The end of U shape is bent upward at end section 30 so that it projects up from the horizontal, to prevent product 4 from slipping off until the consumer is ready to remove it intentionally. The upturn 30 is bent more than the average bends for such display hooks because of the increased moving action of product 4 while hook 2 is pivoting left to right. This design enables the manufacturer to make the entire part from one length of wire bent four times, plus a semi-circular arc. The end 33 of the hook can be configured to accomodate commonly used label holders for bar code scanning, etc., or it can be configured with a loop for the consumer to grasp for the purpose of pivoting the hook left to right in the process of making a selection of product on one hanger assembly and the next, and to make end 33 safer. The length of 27 is preferably longer than the length of 28 to keep product 4 from rubbing up against or hitting wire 26 and base 1. Lengths 35,36 can fluctuate according to the amount of product and thickness of product being displayed/stocked.

FIG. 3 shows base 1 stamped prior to bending operations. The perforated lines represent future bends and the cutouts are shown.

Figure 4:
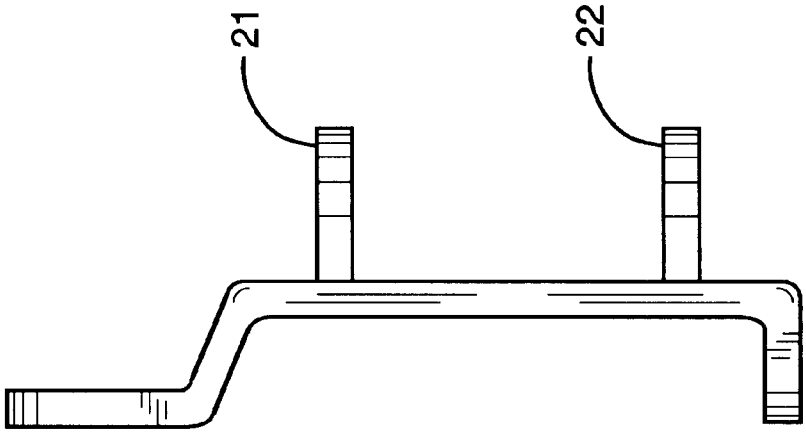
FIG. 4 is a side view of the base member of FIG. 3 after bending operations.

FIG. 4 is a side view after base 1 is stamped and all bends are complete.

FIG. 5 is the complete hanger assembly without product, ready to be inerted into pegboard.

FIG. 6 is a side view showing a cut away of slat wall 37. Base 1 is already inserted into the slat wall and hook 2 with product 4 hanging is resting perpendicular to panel 3, in this case, slat wall. Fingers 9,10 insert into, under and up slat opening 38. Feet 17,18 insert directly into slat opening 39, measured to create a tight fit between openings 38 and 39. This tight fit is accomplished by length 50 from fingers 9,10 to feet 17,18 measured to match length 51. In pegboard, feet 17,18 must reside in the center of the peghole where the length from hole edge to hole edge is the largest. The width of the feet matches the diameter, preventing the movement of the feet within the hole. Slat wall opening 39 has no limitations to pressing against the width of feet 17,18 thereby causing feet 17,18 to depend solely on pressure against the top of opening 39 to prevent rotation of base 1 caused by weight of product 4 being hung on hook 2. With hook 2 perpendicular, product 4 is viewed in a front view. With several of these applied adjacent to each other, the desired effect of compacting, yet making the hanging product more easily viewed, is acheived.

Figure 7:
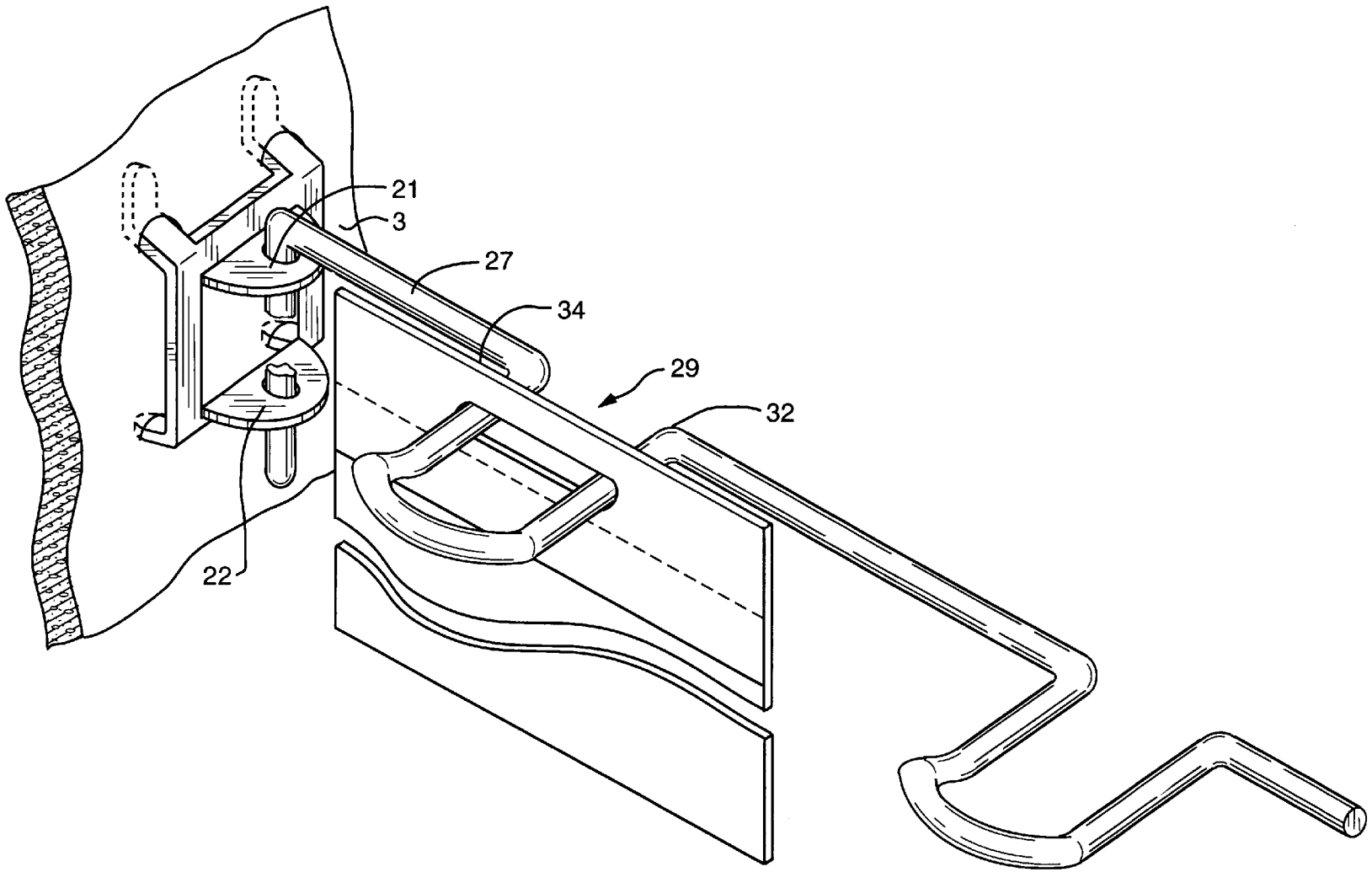
FIG. 7 is a perspective view of another embodiment of the invention, showing the beginnings of several potential varieties.
Figure 8:
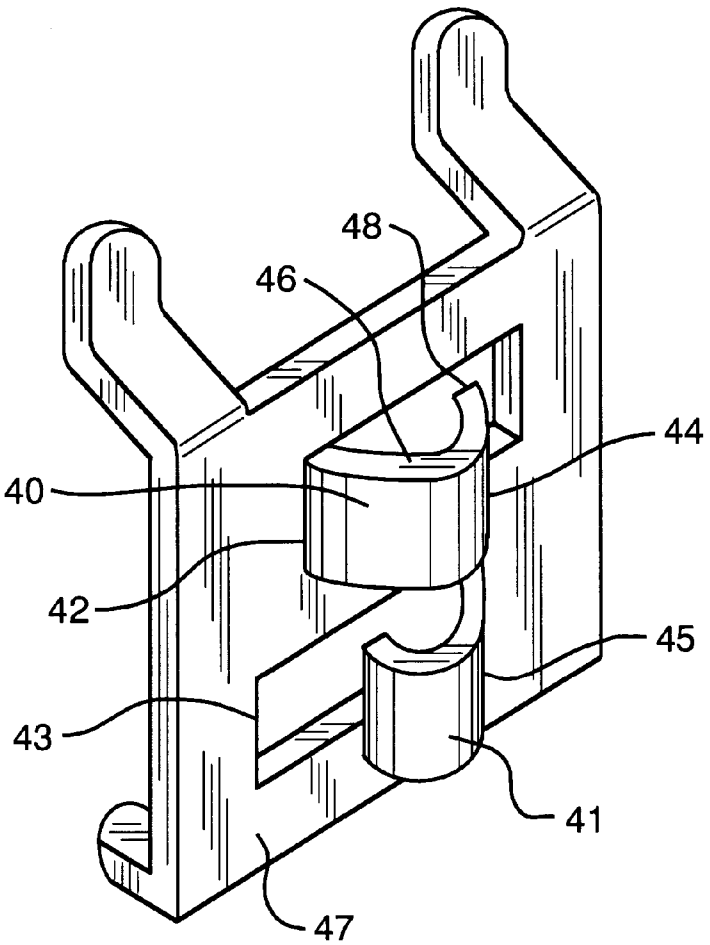
FIG. 8 is a perspective view of another configuration of the base member of the invention that would facilitate the same pivoting motion.

FIG. 7 is a variation of the hanger assembly, representing only one of a number of possible variations which are within the scope of this invention. In this case, two smaller products are being displayed side by side, increasing product choices without increasing space needed. Again, length 27 is longer than the product length 4 which extends beyond the U shape FIG. 8 is a variation of the base member that also facilitates the pivoting hanger assembly. In this version, two opposing hooks 40,41 are punched out of base plate 15. Side 42 of hook 40 is to the right of side 43 of hook 41, as is side 44 of hook 42, to the right of side 45 of hook 41 to ensure that upon arcing hooks 40,41 in opposing directions, the end result are hooks 40,41 being directly above and below each other to facilitate the insertion of wire section 26 into hooks 40,41. Hooks 40,41 are a distance from base plate 15 only sufficient to insert wire 26 with slight resistance. Top edge 46 of upper hook 40 is flat on which hook 2 rests and swivels. Bottom part 47 of base plate 15 has vertical dimension necessary to match extension of wire section 26 that protrudes below hook 41. Distance 48 between the end of hook 40 and base plate 15 is of a small enough space so as to preven wire section 26 from coming out of hook 40 during pivoting action.

Although specific features of this invention are shown in some drawings and not others, this is for convenience only as each feature may be combined with any or all of the other features in accordance with the invention.

Other embodiments will occur to those skilled in the art and are within the following claims:

What is claimed is:

1. A hanger assembly for displaying products in a retail store environment, comprising:

an integral elongated hook member for carrying the product to be displayed, said hook member comprising a proximal end section, a distal end section, and an intermediate portion between said proximal and distal end sections;

said intermediate portion comprising a first, inner, generally straight section adjacent to said proximal end section, and a first arcuate product hanging section adjacent to and more distal than said inner section, wherein said first, inner section of said intermediate portion and said distal end section are generally co-linear and generally horizontal;

a base member defining at least one receiving opening for receiving said proximal end section of said hook member, wherein said hook member can pivot horizontally about said end section, to allow the product being displayed to be moved horizontally; and means for removably fixing said base member to a display panel.

2. The hanger assembly of claim 1 in which said hook member is a bent wire member.

3. The hanger assembly of claim 2, in which said hook member further comprises a bend of about 90° where said proximal end section meets said intermediate portion.

4. The hanger assembly of claim 1, in which said arcuate section comprises a first generally 90° bend where said arcuate section meets said first, inner section, an arcuate portion, and a second generally 90° bend where said arcuate section meets said distal end section.

5. The hanger assembly of claim 4, in which said arcuate section is generally "U" shaped.

6. The hanger assembly of claim 1, wherein said first arcuate product hanging section is generally horizontal.

7. The hanger assembly of claim 6, in which said arcuate portion includes a distal portion that projects up from the horizontal, to inhibit the retail product from sliding off.

8. The hanger assembly of claim 1, in which said intermediate portion further comprises a second arcuate product hanging section, spaced from said first arcuate product hanging section.

9. The hanger assembly of claim 1, in which said base member includes vertically spaced hook member receiving portions, each defining an opening for receiving said hook member proximal end, said openings being generally vertically aligned.

10. The hanger assembly of claim 9, in which said hook member receiving portions each comprise a generally semi circular tab projecting from said base member.

11. The hanger assembly of claim 9, in which said hook member receiving portions each comprise a cantilevered hook projecting from said base member.

12. A hanger assembly for displaying product in a retail store environment, comprising:

an integral elongated wire hook member for carrying the product to be displayed, said hook member comprising a proximal end section, a distal end section, and an intermediate portion between said proximal and distal end sections;

said intermediate portion comprising a first, inner, generally straight and generally horizontal section adjacent to said proximal end section and at an angle of about 90° from said proximal end section and generally co-linear with said distal end section, and a first generally horizontal arcuate product hanging section adjacent to said inner section, in which said arcuate section comprises a first generally 90° bend where said arcuate section meets said first, inner section, a generally "U" shaped arcuate portion which projects up at its end from the horizontal, and a second generally 90° bend where said arcuate section meets said distal end section;

a base member defining at least one receiving opening for receiving said proximal end section of said hook member, wherein said hook member can pivot horizontally about said end section, to allow the product being displayed to be moved horizontally, in which said base member includes vertically spaced hook member receiving portions, each defining an opening for receiving said hook member proximal end, said openings being generally vertically aligned; and means for removably fixing said base member to a display panel.

13. The hanger assembly of claim 12, in which said intermediate portion further comprises a second arcuate product hanging section, spaced from said first arcuate product hanging section.

14. The hanger assembly of claim 12, in which said hook member receiving portions each comprise a generally semi circular tab projecting from said base member.

15. The hanger assembly of claim 12, in which said hook member receiving portions each comprise a cantilevered hook projecting from said base member.

* * * * *